US008349388B1

(12) United States Patent
Yip et al.

(10) Patent No.: US 8,349,388 B1
(45) Date of Patent: Jan. 8, 2013

(54) METHOD OF COATING A STENT

(75) Inventors: Philip S. Yip, San Jose, CA (US); Fuh-Wei Tang, Temecula, CA (US); Anthony Andreacchi, San Jose, CA (US)

(73) Assignee: Advanced Cardiovascular Systems, Inc., Santa Clara, CA (US)

( * ) Notice: Subject to any disclaimer, the term of this patent is extended or adjusted under 35 U.S.C. 154(b) by 1744 days.

(21) Appl. No.: 10/805,047

(22) Filed: Mar. 18, 2004

(51) Int. Cl.
*B05D 1/00* (2006.01)
*B05D 3/00* (2006.01)
*B05C 13/00* (2006.01)

(52) U.S. Cl. ..... 427/2.24; 427/2.1; 427/2.25; 427/290; 118/500

(58) Field of Classification Search ..... 427/2.1, 427/2.24; 118/500
See application file for complete search history.

(56) References Cited

U.S. PATENT DOCUMENTS

| | | | | |
|---|---|---|---|---|
| 4,629,563 | A | 12/1986 | Wrasidlo | 210/500.34 |
| 4,733,665 | A | 3/1988 | Palmaz | 128/343 |
| 4,800,882 | A | 1/1989 | Gianturco | 128/343 |
| 4,886,062 | A | 12/1989 | Wiktor | 128/343 |
| 4,906,423 | A | 3/1990 | Frisch | 264/48 |
| 5,037,427 | A | 8/1991 | Harada et al. | 606/108 |
| 5,171,445 | A | 12/1992 | Zepf | 210/500.27 |
| 5,188,734 | A | 2/1993 | Zepf | 210/490 |
| 5,229,045 | A | 7/1993 | Soldani | 264/41 |
| 5,234,457 | A | 8/1993 | Andersen | 606/198 |
| 5,537,729 | A | 7/1996 | Kolobow | 29/527.2 |
| 5,611,775 | A | 3/1997 | Machold et al. | 604/53 |
| 5,624,411 | A | 4/1997 | Tuch | 604/265 |
| 5,628,786 | A | 5/1997 | Banas et al. | 623/1 |
| 5,772,864 | A | 6/1998 | Møller et al. | 205/73 |
| 5,788,626 | A | 8/1998 | Thompson | 600/36 |
| 5,820,917 | A | 10/1998 | Tuch | 427/2.1 |
| 5,823,996 | A | 10/1998 | Sparks | 604/96 |
| 5,833,659 | A | 11/1998 | Kranys | 604/96 |
| 5,855,598 | A | 1/1999 | Pinchuk | 623/1 |
| 5,865,814 | A | 2/1999 | Tuch | 604/265 |
| 5,895,407 | A | 4/1999 | Jayaraman | 606/198 |
| 5,897,911 | A | 4/1999 | Loeffler | 427/2.25 |
| 5,922,393 | A | 7/1999 | Jayaraman | 427/2.3 |
| 5,935,135 | A | 8/1999 | Bramfitt et al. | 606/108 |
| 5,948,018 | A | 9/1999 | Dereume et al. | 623/1 |
| 6,010,573 | A | 1/2000 | Bowlin | 118/620 |
| 6,045,899 | A | 4/2000 | Wang et al. | 428/315.7 |
| 6,056,993 | A | 5/2000 | Leidner et al. | 427/2.25 |
| 6,120,847 | A | 9/2000 | Yang et al. | 427/335 |
| 6,126,686 | A | 10/2000 | Badylak et al. | 623/1.24 |
| 6,153,252 | A | 11/2000 | Hossainy et al. | 427/2.3 |
| 6,156,373 | A | 12/2000 | Zhong et al. | 427/2.28 |
| 6,214,115 | B1 | 4/2001 | Taylor et al. | 118/423 |
| 6,245,099 | B1 | 6/2001 | Edwin et al. | 623/1.13 |
| 6,258,121 | B1 | 7/2001 | Yang et al. | 623/1.46 |

(Continued)

OTHER PUBLICATIONS

Examples of Solubility Parameters, Jul. 20, 1995, http://web.umr.edu/wlf/Soulution/solparaexp.html, pp. 1-5.*

(Continued)

*Primary Examiner* — Timothy Meeks
*Assistant Examiner* — Cachet Sellman
(74) *Attorney, Agent, or Firm* — Squire Sanders (US) LLP

(57) ABSTRACT

A stent mounting device and a method of coating a stent using the device are provided. The mandrel is made from or is coated with a hydrophobic or hydrophilic material, depending on the type of coating composition that is employed.

33 Claims, 2 Drawing Sheets

U.S. PATENT DOCUMENTS

| | | | | |
|---|---|---|---|---|
| 6,279,368 | B1 | 8/2001 | Escano et al. | 72/342.1 |
| 6,287,628 | B1 | 9/2001 | Hossainy et al. | 427/2.3 |
| 6,322,847 | B1 | 11/2001 | Zhong et al. | 427/2.28 |
| 6,350,009 | B1 * | 2/2002 | Freund et al. | 347/35 |
| 6,364,903 | B2 | 4/2002 | Tseng et al. | 623/1.15 |
| 6,379,381 | B1 | 4/2002 | Hossainy et al. | 623/1.42 |
| 6,387,118 | B1 | 5/2002 | Hanson | 623/1.11 |
| 6,511,462 | B1 * | 1/2003 | Itou et al. | 604/264 |
| 6,521,284 | B1 | 2/2003 | Parsons et al. | 427/2.24 |
| 6,527,863 | B1 | 3/2003 | Pacetti et al. | 118/500 |
| 6,565,659 | B1 * | 5/2003 | Pacetti et al. | 118/500 |
| 6,572,644 | B1 * | 6/2003 | Moein | 623/1.11 |
| 6,605,154 | B1 | 8/2003 | Villareal | 118/500 |
| 6,649,222 | B1 | 11/2003 | D'Agostino et al. | |
| 6,673,154 | B1 | 1/2004 | Pacetti et al. | 118/500 |
| 6,682,771 | B2 * | 1/2004 | Zhong et al. | 427/2.24 |
| 6,695,920 | B1 | 2/2004 | Pacetti et al. | 118/500 |
| 6,713,119 | B2 | 3/2004 | Hossainy et al. | 427/2.25 |
| 6,749,626 | B1 | 6/2004 | Bhat et al. | 623/1.1 |
| 2003/0050692 | A1 * | 3/2003 | Sirhan et al. | 623/1.42 |

OTHER PUBLICATIONS

U.S. Appl. No. 10/254,203, filed Sep. 24, 2002, Kerrigan.

U.S. Appl. No. 10/255,913, filed Sep. 26, 2002, Tang et al.

U.S. Appl. No. 10/304,669, filed Nov. 25, 2002, Madriaga et al.

Van Iseghem, Lawrence C. et al., "Important Concepts on Coating Plastics from a Formulator's Perspective," Modern Paint and Coatings, pp. 30-38 Feb. 1998.

* cited by examiner

METHOD OF COATING A STENT

BACKGROUND OF THE INVENTION

1. Field of the Invention

This invention relates to a stent mounting device and a method of coating a stent using the device.

2. Description of the Background

Blood vessel occlusions are commonly treated by mechanically enhancing blood flow in the affected vessels, such as by employing a stent. Stents act as scaffoldings, functioning to physically hold open and, if desired, to expand the wall of the passageway. Typically stents are capable of being compressed, so that they can be inserted through small lumens via catheters, and then expanded to a larger diameter once they are at the desired location. Examples in the patent literature disclosing stents include U.S. Pat. No. 4,733,665 issued to Palmaz, U.S. Pat. No. 4,800,882 issued to Gianturco, and U.S. Pat. No. 4,886,062 issued to Wiktor.

FIG. 1 illustrates a conventional stent 10 formed from a plurality of struts 12. The plurality of struts 12 are radially expandable and interconnected by connecting elements 14 that are disposed between adjacent struts 12, leaving lateral openings or gaps 16 between adjacent struts 12. Struts 12 and connecting elements 14 define a tubular stent body having an outer, tissue-contacting surface and an inner surface.

Stents are used not only for mechanical intervention but also as vehicles for providing biological therapy. Biological therapy can be achieved by medicating the stents. Medicated stents provide for the local administration of a therapeutic substance at the diseased site. Local delivery of a therapeutic substance is a preferred method of treatment because the substance is concentrated at a specific site and thus smaller total levels of medication can be administered in comparison to systemic dosages that often produce adverse or even toxic side effects for the patient.

One method of medicating a stent involves the use of a polymeric carrier coated onto the surface of the stent. For example, a composition including a solvent, a polymer dissolved in the solvent, and a therapeutic substance dispersed in the blend can be applied to the stent by immersing the stent in the composition or by spraying the composition onto the stent. The solvent is allowed to evaporate, leaving on the stent strut surfaces a coating of the polymer and the therapeutic substance impregnated in the polymer.

The dipping or spraying of the composition onto the stent can result in a complete coverage of all stent surfaces, i.e., both luminal and abluminal surfaces, with a coating. However, from a therapeutic standpoint, drugs need only be released from the abluminal stent surface, and possibly the sidewalls. Moreover, having a coating on the luminal surface of the stent can have a detrimental impact on the stent's deliverability as well as the coating's mechanical integrity. A polymeric coating can increase the coefficient of friction between the stent and the delivery balloon. Additionally, some polymers have a "sticky" or "tacky" consistency. If the polymeric material either increases the coefficient of friction or adherers to the catheter balloon, the effective release of the stent from the balloon after deflation can be compromised. Adhesive, polymeric stent coatings can also experience extensive balloon shear damage post-deployment, which could result in a thrombogenic stent surface. Accordingly, there is a need to eliminate or minimize the amount of coating that is applied to the inner surface of the stent.

A method for preventing the composition from being applied to the inner surface of the stent is by placing the stent over a mandrel that fittingly mates within the inner diameter of the stent. A tubing can be inserted within the stent such that the outer surface of the tubing is in contact with the inner surface of the stent. With the use of such mandrels, some incidental composition can seep into the gaps or spaces between the surfaces of the mandrel and the stent, especially if the coating composition includes high "wetting" solvents. Moreover, a tubular mandrel that makes contact with the inner surface of the stent can cause coating defects. A high degree of surface contact between the stent and the supporting apparatus can provide regions in which the liquid composition can flow, wick, and collect as the composition is applied to the stent. As the solvent evaporates, the excess composition hardens to form excess coating at and around the contact points between the stent and the supporting apparatus. Upon removal of the coated stent from the supporting apparatus, the excess coating may stick to the apparatus, thereby removing some of the coating from the stent and leaving bare areas. Alternatively, the excess coating may stick to the stent, thereby leaving excess coating composition as clumps or pools on the struts or webbing between the struts.

Accordingly, there is a tradeoff when the inner surface of the stent is masked in that coating defects such as pools and clumps can be formed on the stent. There is a need for eliminating or at least minimizing the coating that is formed on the inner surface of the stent as well as coating defects that are formed on the stent struts or between the stent struts caused by the high degree of surface contact between the stent and the mandrel. A mandrel design and a method of using the same is need that addresses these concerns.

SUMMARY OF THE INVENTION

A method of applying a coating composition to a stent is provided, comprising positioning a stent on a mandrel and applying a coating composition including a solvent to the stent. If the solvent is polar, then the mandrel selected for supporting the stent is made from or a surface of the mandrel is coated with a hydrophobic material. If the solvent is non-polar, then the mandrel selected for supporting the stent is made from or the surface of the mandrel is coated with a hydrophilic material. In accordance with one embodiment, the hydrophobic material has a $\delta$ value (as defined in the detail description) of below about 9.9 $(cal/cm^3)^{1/2}$, and the hydrophilic material has a $\delta$ value of about 10.1 $(cal/cm^3)^{1/2}$ or higher. The outer surface of the mandrel can be in contact with an inner surface of the stent. Alternatively, the mandrel can be designed such that there is no or minimal contact between the surfaces of the mandrel and the stent.

A method of coating a stent is provided comprising positioning a stent on a mandrel; and applying a coating composition to the stent, wherein the contact angle of the composition on the surface of the stent or a coating on the surface of the stent is smaller than the contact angle of the composition on the surface of the mandrel. In one embodiment, the contact angle of the composition on the surface of the mandrel should be greater than 90°.

BRIEF DESCRIPTION OF THE FIGURES

The following figures have been provided to better illustrate the embodiments of the invention. The figures have not been drawn to scale as some features have been over or under emphasized for illustrative purposes.

DETAILED DESCRIPTION

Definitions

"Contact angle" is defined as an angle at the tangent of a droplet in a fluid phase that has taken an equilibrium shape on a solid surface under ambient condition.

Figure 2A:
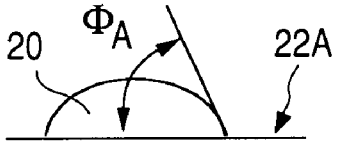
FIG. 2A illustrates a fluid on a solid substrate having a contact angle $\phi_A$.
Figure 2B:
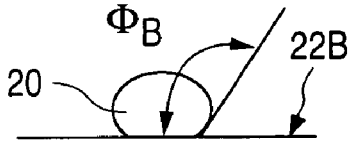
FIG. 2B illustrates a fluid on a solid substrate having a contact angle $\phi_B$.

"Capillary permeation" or "wetting" is the movement of a fluid on a solid substrate driven by interfacial energetics. Capillary permeation is quantitated by contact angle. A low contact angle indicates a higher "wetting" liquid. A suitably high capillary permeation, for example, can correspond to a contact angle less than about 90°. FIG. 2A illustrates a droplet 20 of the coating substance on a flat surface 22A. Fluid droplet 20 has a "high" capillary permeation that corresponds to a contact angle $\phi_A$, which is less than about 90°. By contrast, FIG. 2B illustrates fluid droplet 20 on a surface 22B having a "low" capillary permeation that corresponds to a contact angle $\phi_B$, which is greater than about 90°.

Hydrophobicity can be gauged using the Hildebrand solubility parameter δ. The term "Hildebrand solubility parameter" refers to a parameter indicating the cohesive energy density of a substance. The δ parameter is determined as follows:

$$\delta=(\Delta E/V)^{1/2}$$

where δ is the solubility parameter, $(cal/cm^3)^{1/2}$;
ΔE is the energy of vaporization, cal/mole; and
V is the molar volume, $cm^3$/mole.

Whether a material is hydrophobic or hydrophilic is relative. Between different materials, whichever has a lower δ value compared to the δ value of the other is designated as a hydrophobic, and the material with higher δ value is designated as a hydrophilic. For example, between a stent (or a coating of the stent) and a mandrel (or a coating of the mandrel), whichever has the lower Hildebrand value is designated as "hydrophobic" and the other is designated as "hydrophilic." Accordingly, for the practice of the present invention, the δ value of a particular material is inconsequential for classifying the material as hydrophobic or hydrophilic so long as the mandrel, when used in combination with the coating composition, achieves its intended design of preventing or reducing the amount of coating composition or solvent that seeps in the spaces between the mandrel and the outer surface of the stent and/or prevents or reduces coating defects from forming on the stent. In one embodiment, the δ value defining the boundary between hydrophobic and hydrophilic can be between about 9.9 and 10.1 $(cal/cm^3)^{1/2}$. According to this embodiment, hydrophobic is defined as having a δ value equal to or below about 9.9 $(cal/cm^3)^{1/2}$, and hydrophilic is defined as having a δ value of about 10.1 $(cal/cm^3)^{1/2}$ or higher. Materials having a δ value between about 9.9 and 10.1 $(cal/cm^3)^{1/2}$ can exhibit behavior characterized by both hydrophilic and hydrophobic materials. Such materials are defined as "amphiphilic." Measurements other than Hildebrand value can also be used to determine the hydrophobicity of the material and the general principle of the mandrel or coated mandrel being more hydrophobic or hydrophilic than the stent or coated stent should be equally applicable as well.

Polar substances are defined as having a separation of electrical charge into positive and negative centers. In contrast, in a non-polar molecule, the centers of positive and negative charge coincide and there is there is no separation of charge within the molecule. In one embodiment, polar is defined as having a dipole moment greater and 0 debye and non-polar is defined as having a dipole moment equal to about 0 debye. In some embodiments, depending on the hyrophobicity of the mandrel, some materials with low dipole moments can also be classified as being non-polar for the purpose of the present invention. Accordingly, the dipole value of a particular solvent can be inconsequential for classifying the solvent as polar or non-polar so long as the mandrel, when used in combination with the coating composition, achieves its intended design of preventing or reducing the amount of coating composition or solvent that seeps in the spaces between the mandrel and the outer surface of the stent and/or prevents or reduces coating defects from forming on the stent. In another embodiment, polar is defined as having a dipole moment greater than (and non-polar is defined as having a dipole moment less than) about 0.8, preferably about 1.4 debye. Table 1 list examples of solvents and their dipole moments:

TABLE 1

Solvent Dipole Moment

| Solvent | Dipole Moment (debye) |
|---|---|
| Carbon Tetrachloride | 0 |
| Cyclohexane | ~0 |
| Cyclopentane | 0.00 |
| Decahydronaphthalene | 0 |
| Heptane | 0.0 |
| Hexadecane | ~0 |
| Pentane | 0.00 |
| Iso-Octane | 0 |
| Hexane | ~0 |
| Toluene | 0.31 |
| Dioxane | 0.45 |
| Ortho-Xylene | 0.45 |
| Trichloroethylene | 0.8 |
| Methylene Chloride | 1.14 |
| Chloroform | 1.15 |
| Ethyl Ether | 1.15 |
| Methyl t-Butyl Ether | 1.32 |
| Chlorobenzene | 1.54 |
| Isopropyl Alcohol | 1.66 |
| Glyme | 1.71 |
| n-Butyl Alcohol | 1.75 |
| Tetrahydrofuran | 1.75 |
| Isobutyl Alcohol | 1.79 |
| n-Butyl Acetate | 1.84 |
| Ethylene Dichloride | 1.86 |
| Water | 1.87 |
| Ethyl Acetate | 1.88 |
| n-Butyl Chloride | 1.90 |
| 2-Methoxyethanol | 2.04 |
| Ortho-Dichlorobenzene | 2.27 |
| Pyridine | 2.37 |
| Methyl Ethyl Ketone | 2.76 |
| Acetone | 2.69 |
| Methanol | 2.87 |
| n-Propyl Alcohol | 3.09 |
| Acetonitrile | 3.44 |
| Dimethyl Acetamide | 3.72 |
| Dimethyl Formamide | 2.86 |
| Dimethyl Sulfoxide | 3.9 |
| N-Methylpyrrolidone | 4.09 |

Dipole moments provided by "Solvent Guide, Third Edition, by Burdick and Jackson." The value of debye can vary depending on the methodology of measurement, temperature, and the accuracy of the measured distance between centers of opposing charges.

Support Apparatus or Mandrel

Figure 1:
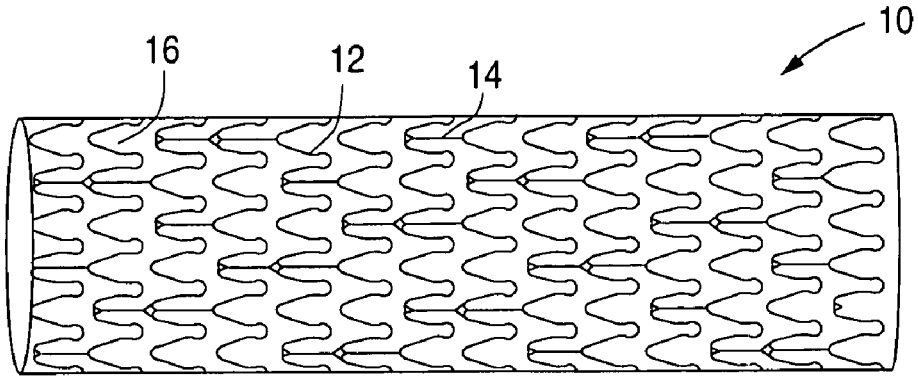
FIG. 1 (PRIOR ART)
FIG. 1 illustrates a conventional stent.
Figure 3A:
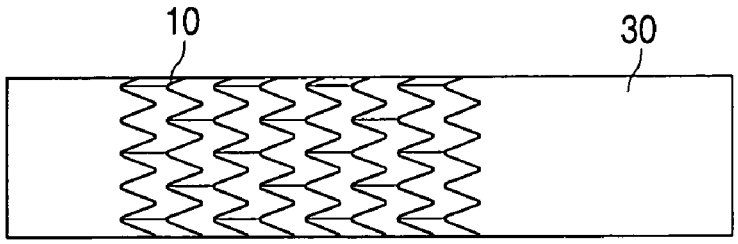
FIGS. 3A-3C illustrates mounting assemblies for supporting a stent in accordance with various embodiment of the present invention.
Figure 3B:
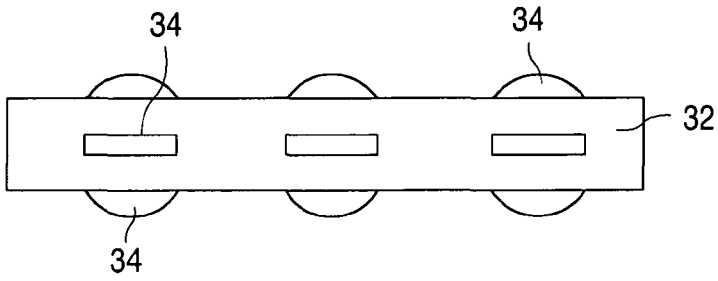
Figure 3C:
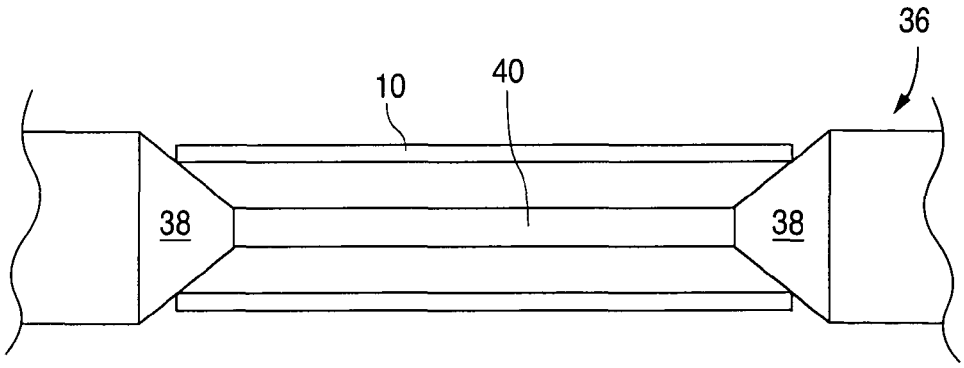

In embodiments of the invention, a stent, such as the stent illustrated by FIG. 1, is placed over a mandrel or any suitable support apparatus for supporting the stent during the application of a coating composition. FIG. 3A illustrates one embodiment of a mandrel 30 that can be used during the coating process. The mandrel 30 has a tubular body that can be fittingly inserted into the hollow longitudinal bore of the stent 10. The outer surface of the mandrel 30 can make contact with the inner surface of the stent 10 to mask the inner surface of the stent 10 and prevent the coating from contacting the inner surface of the stent 10. In yet another embodiment, as illustrated by FIG. 3B, a mandrel 32 includes a tubular body having members or fins 34 extending out from the tubular body. The fins 34 act as spacers to create a space between an outer surface of a stent and the inner surface of the mandrel 32. The fins 34 prevent the outer surface of the mandrel 32, more specifically the outer surface the tubular body, from making contact with the inner surface of a stent so as to minimize contact areas around which the coating composition can collect and wick. In yet another embodiment, as illustrated by FIG. 3C, a mandrel 36 can include a pair of coning ends 38 that can penetrate partially within opposing ends of the stent 10. The coning ends 38 are coupled together via a mandrel arm 40 that extend through the longitudinal bore of the stent 10. The outer surface of the mandrel arm 40 does not make contact with the inner surface of the stent 10 such that the mandrel 36 minimizes contact with the stent 10 at only the end rings of the stent 10.

In accordance with another embodiment of the invention, the mandrel can be an inflatable bladder. The bladder can have a deflated profile that can be inserted through the longitudinal bore of the stent. In an expanded configuration, the bladder can be used to securely support the stent during the coating process while masking the inner surface of the stent. Other assemblies and devices for supporting a stent during the application of the coating composition are also contemplated to be included with the embodiments of the present invention.

Method of Selection of the Mandrel

The selection of the type of mandrel to be used during the coating process is dependent on the choice solvent or solvents included in the coating composition. In one embodiment, if the solvent is polar or mixture of solvents exhibits a polar characteristic, the mandrel selected for the process should be made from a hydrophobic material or the surfaces of the mandrel should be coated with a hydrophobic material. In some embodiments, the mandrel or the coating on the mandrel should be more hydrophobic than the stent or a coating on the stent. In some embodiments, the hydrophobicity of the mandrel or a coating on the mandrel can be at least 0.2 times greater than the stent or a coating on the stent (e.g., if the stent or a coating on a stent has a Hildebrand value of 10.0 $(cal/cm^3)^{1/2}$, the mandrel or a coating on the mandrel should have a Hildebrand value of 8 $(cal/cm^3)^{1/2}$ or less); or alternatively, at least 0.5 greater than the stent or a coating on the stent (e.g., if the stent or a coating on the stent has a Hildebrand value of 10.0 $(cal/cm^3)^{1/2}$, the mandrel or a coating on the mandrel should have a Hildebrand value of 5 $(cal/cm^3)^{1/2}$ or less). Alternatively, the hydrophilicity of the stent or a coating on the stent can be at least 0.2 times greater than the mandrel or a coating on the mandrel (e.g., if the mandrel or a coating on the mandrel has a Hildebrand value of 8 $(cal/cm^3)^{1/2}$, the stent or a coating on a stent should have a Hildebrand value of 9.6 $(cal/cm^3)^{1/2}$ or more); or alternatively, at least 0.5 greater than the mandrel or a coating on the mandrel (e.g., if the mandrel or a coating on the mandrel has a Hildebrand value of 8.0 $(cal/cm^3)^{1/2}$, the stent or a coating on the stent should have a Hildebrand value of 12 $(cal/cm^3)^{1/2}$ or more).

By way of illustration, if the coating composition includes water, alcohol, dimethyl formamide, dimethyl sulfoxide, dimethyl acetamide, acetonitrile, methanol, acetone or mixtures thereof, mandrels made from or coated with polymers of hydrocarbon (e.g., polyethylene), fluorocarbon (e.g., polytetrafluoroethylene), nylon, and polyesters could be used. Mandrels made from or coated with silicone or silicone based materials, for example poly(dialky siloxane), poly(dimethyl siloxane), poly (dipropyl siloxane) or poly(dihexyl siloxane) can also be used. In some embodiments, the mandrel surface can be made from or coated with a wax, such as paraffin or ethylenic wax. In other embodiments, hydrophobic surfaces can be made with a coating of fluorocarbon, such as tetrafluoroethylene, or a polymer or copolymer of tetrafluoroethylene, chlorotrifluoroethylene, fluorinated ethylene-propylene, hexafluoropropylene, and the like. In some embodiments, a fluorocarbon surface can be made on a substrate, such as a polymeric substrate, by plasma glow discharge. For example, a plasma glow discharge treatment process can produce a coating in the presence of a fluorocarbon gas or vapor, such as tetrafluoroethylene (TFE), hexafluoropropene (HFP), perfluoro-(2-trifluoromethyl-)pentene, perfluoro-(2-methylpentene) or its trimer (as described in U.S. Pat. No. 6,649,222).

If the solvent is non-polar or if the solvents exhibit a non-polar characteristic, then the mandrel selected should be made from a hydrophilic material or be coated with such material. In some embodiments, the mandrel or a coating on the mandrel should be more hydrophilic than the stent or a coating on the stent surface. In some embodiments, the hydrophilicity of the mandrel or a coating on the mandrel can be at least 0.2 times greater than the stent or a coating on the stent (e.g., if the stent or a coating on the stent has a Hildebrand value of 8 $(cal/cm^3)^{1/2}$, the mandrel or a coating on the mandrel should have a Hildebrand value of 9.6 $(cal/cm^3)^{1/2}$ or more); or alternatively at least 0.5 greater than the stent or a coating on the stent (e.g., if the stent or a coating on the stent has a Hildebrand value of 8 $(cal/cm^3)^{1/2}$, the mandrel or a coating on the mandrel should have a Hildebrand value of 12 $(cal/cm^3)^{1/2}$ or more). Alternatively, the hydrophobicity of the stent or a coating on the stent can be at least 0.2 times greater than the mandrel or a coating on the mandrel (e.g., if the mandrel or a coating on the mandrel has a Hildebrand value of 10 $(cal/cm^3)^{1/2}$, the stent or a coating on the stent should have a Hildebrand value of 8 $(cal/cm^3)^{1/2}$ or lower); or alternatively at least 0.5 greater than the mandrel or a coating on the mandrel (e.g., if the mandrel or a coating on the mandrel has a Hildebrand value of 10 $(cal/cm^3)^{1/2}$, the stent or a coating on the stent should have a Hildebrand value of 5 $(cal/cm^3)^{1/2}$ or lower).

By way of illustration, with the use of aliphatic hydrocarbons such as pentane, hexane, or heptane, cycloaliphatics such as cyclohexane, and aromatics such as benzene, xylene, and toluene, mandrels made from or coated with metals such as aluminum oxide, steel, etc. can be used. The mandrel material can also be a hydrophilic polymer, such as polyethylene glycol, so long as the mandrel is not adversely affected when exposed to the coating composition.

In accordance with another embodiment, the selection of the mandrel is based on the contact angle of the coating composition on the surface of the mandrel as compared to the surface of the stent or a coating deposited on the surface of the stent. The contact angle of the composition should be smaller on the surface of the stent or a coating deposited on the surface of the stent as compared to the measured contact angle on the surface of the mandrel. The surface of the stent is defined as the luminal surface and/or the abluminal surface. In one embodiment, it is preferred that a mandrel be selected such that the composition used has a contact angle greater than 90° on the surface of the mandrel and less than 90° on the surface of the stent or a coating on the surface of the stent. In other embodiments, the value of the contact angle for the composition on the mandrel should be greater than 120°, 110°, 100°, 80°, or alternatively 70°. In some embodiments, the value of the contact angle for the composition on the surface of the stent or a coating on the stent should be less than 120°, 110°, 100°, 80°, or alternatively 70°. In some embodiments, the contact angle on the surface of the stent can also be greater than 120°, 110°, 100°, 90°, 80°, or alternatively 70°.

Coating a Stent Using the Mounting Assembly

The following method of spray application is being provided by way of illustration and is not intended to limit the embodiments the present invention. For example, instead of a spray process, the coating composition can also be applied by dipping or by use of a roller or sponge applicator. A spray apparatus, such as EFD 780S spray device with VALVEMATE 7040 control system (manufactured by EFD Inc., East Providence, R.I.), can be used to apply a composition to a stent. EFD 780S spray device is an air-assisted external mixing atomizer. The composition is atomized into small droplets by air and uniformly applied to the stent surfaces. The atomization pressure can be maintained at a range of about 5 psi to about 20 psi. The droplet size depends on such factors as viscosity of the solution, surface tension of the solvent, and atomization pressure. Other types of spray applicators, including air-assisted internal mixing atomizers and ultrasonic applicators, can also be used for the application of the composition.

During the application of the composition, a stent supported by the mandrel can be rotated about the stent's central longitudinal axis. Rotation of the stent can be from about 1 rpm to about 300 rpm, more narrowly from about 50 rpm to about 150 rpm. By way of example, the stent can rotate at about 120 rpm. The stent can also be moved in a linear direction along the same axis. The stent can be moved at about 1 mm/second to about 12 mm/second, for example about 6 mm/second, or for a minimum of at least two passes (i.e., back and forth past the spray nozzle). The flow rate of the solution from the spray nozzle can be from about 0.01 mg/second to about 1.0 mg/second, more narrowly about 0.1 mg/second. Multiple repetitions for applying the composition can be performed, wherein each repetition can be, for example, about 1 second to about 10 seconds in duration. The amount of coating applied by each repetition can be about 0.1 micrograms/$cm^2$ (of stent surface) to about 40 micrograms/$cm^2$, for example less than about 2 micrograms/$cm^2$ per 5-second spray.

Each repetition can be followed by removal of a significant amount of the solvent. Depending on the volatility of the particular solvent employed, the solvent can evaporate essentially upon contact with the stent. Alternatively, removal of the solvent can be induced by baking the stent in an oven at a mild temperature (e.g., 60° C.) for a suitable duration of time (e.g., 2-4 hours) or by the application of warm air. The application of warm air between each repetition prevents coating defects and minimizes interaction between the active agent and the solvent. The temperature of the warm air can be from about 30° C. to about 60° C., more narrowly from about 40° C. to about 50° C. The flow rate of the warm air can be from about 20 cubic feet/minute (CFM) (0.57 cubic meters/minute (CMM)) to about 80 CFM (2.27 CMM), more narrowly about 30 CFM (0.85 CMM) to about 40 CFM (1.13 CMM). The warm air can be applied for about 3 seconds to about 60 seconds, more narrowly for about 10 seconds to about 20 seconds. By way of example, warm air applications can be performed at a temperature of about 50° C., at a flow rate of about 40 CFM, and for about 10 seconds. Any suitable number of repetitions of applying the composition followed by removing the solvent(s) can be performed to form a coating of a desired thickness or weight. Excessive application of the polymer in a single application can, however, cause coating defects.

Operations such as wiping, centrifugation, shaking or other web clearing acts can also be performed to achieve a more uniform coating. Briefly, wiping refers to the physical removal of excess coating from the surface of the stent; centrifugation refers to rapid rotation of the stent about an axis of rotation; and shaking refers to gentle vibration of the stent for discarding the excess coating composition. Deposition of a polar substance on a hydrophobic mandrel, or non-polar substance on hydrophilic mandrel, facilitates the removal of the excess composition by such acts.

Coating Composition

The coating composition can include a polymer or mixture of polymers added to a solvent or mixture of solvents. Representative examples of polymers that can be used to coat a stent include ethylene vinyl alcohol copolymer (commonly known by the generic name EVOH or by the trade name EVAL); poly(vinylidene fluoride-co-hexafluoropropene); poly(hydroxyvalerate); poly(L-lactic acid); polycaprolactone; poly(lactide-co-glycolide); poly(hydroxybutyrate); poly(hydroxybutyrate-co-valerate); polydioxanone; polyorthoester; polyanhydride; poly(glycolic acid); poly(D,L-lactic acid); poly(glycolic acid-co-trimethylene carbonate); polyphosphoester; polyphosphoester urethane; poly(amino acids); cyanoacrylates; poly(trimethylene carbonate); poly (iminocarbonate); copoly(ether-esters) (e.g. PEO/PLA); polyalkylene oxalates; polyphosphazenes; biomolecules, such as fibrin, fibrinogen, cellulose, starch, collagen and hyaluronic acid; polyurethanes; silicones; polyesters; polyolefins; polyisobutylene and ethylene-alphaolefin copolymers; acrylic polymers and copolymers; vinyl halide polymers and copolymers, such as polyvinyl chloride; polyvinyl ethers, such as polyvinyl methyl ether; polyvinylidene halides, such as polyvinylidene fluoride and polyvinylidene chloride; polyacrylonitrile; polyvinyl ketones; polyvinyl aromatics, such as polystyrene; polyvinyl esters, such as polyvinyl acetate; copolymers of vinyl monomers with each other and olefins, such as ethylene-methyl methacrylate copolymers, acrylonitrile-styrene copolymers, ABS resins, and ethylene-vinyl acetate copolymers; polyamides, such as Nylon 66 and polycaprolactam; alkyd resins; polycarbonates; polyoxymethylenes; polyimides; polyethers; epoxy resins; polyurethanes; rayon; rayon-triacetate; cellulose; cellulose acetate; cellulose butyrate; cellulose acetate butyrate; cellophane; cellulose nitrate; cellulose propionate; cellulose ethers; and carboxymethyl cellulose.

"Solvent" is defined as a liquid substance or composition that is compatible with the polymer and is capable of dissolving the polymer at the concentration desired in the composition. Examples of solvents include, but are not limited to, the solvents listed in Table 1.

The composition can also include a drug or an active agent. The active agent could be for inhibiting the activity of vascular smooth muscle cells. More specifically, the active agent can be aimed at inhibiting abnormal or inappropriate migration and/or proliferation of smooth muscle cells for the inhibition of restenosis. The active agent can also include any substance capable of exerting a therapeutic or prophylactic effect. For example, the agent can be for enhancing wound healing in a vascular site or improving the structural and elastic properties of the vascular site. Examples of agents include antiproliferative substances such as actinomycin D, or derivatives and analogs thereof (manufactured by Sigma-Aldrich 1001 West Saint Paul Avenue, Milwaukee, Wis. 53233; or COSMEGEN available from Merck). The active agent can also fall under the genus of antineoplastic, antiinflammatory, antiplatelet, anticoagulant, antifibrin, antithrombin, antimitotic, antibiotic, antiallergic and antioxidant substances. Examples of such antineoplastics and/or antimitotics include paclitaxel (e.g. TAXOL® by Bristol-Myers Squibb Co., Stamford, Conn.), docetaxel (e.g. TAXOTERE®, from Aventis S.A., Frankfurt, Germany) methotrexate, azathioprine, vincristine, vinblastine, fluorouracil, doxorubicin hydrochloride (e.g. ADRIAMYCIN® from Pharmacia & Upjohn, Peapack N.J.), and mitomycin (e.g. MUTAMYCIN® from Bristol-Myers Squibb Co., Stamford, Conn.). Examples of such antiplatelets, anticoagulants, antifibrin, and antithrombins include sodium heparin, low molecular weight heparins, heparinoids, hirudin, argatroban, forskolin, vapiprost, prostacyclin and prostacyclin analogues, dextran, D-phe-pro-arg-chloromethylketone (synthetic antithrombin), dipyridamole, glycoprotein IIb/IIIa platelet membrane receptor antagonist antibody, recombinant hirudin, and thrombin inhibitors such as ANGIOMAX™ (Biogen, Inc., Cambridge, Mass.). Examples of such cytostatic or antiproliferative agents include angiopeptin, angiotensin converting enzyme inhibitors such as captopril (e.g. CAPOTEN® and CAPOZIDE® from Bristol-Myers Squibb Co., Stamford, Conn.), cilazapril or lisinopril (e.g. PRINIVIL® and PRINZIDE® from Merck & Co., Inc., Whitehouse Station, N.J.); calcium channel blockers (such as nifedipine), colchicine, fibroblast growth factor (FGF) antagonists, fish oil (omega 3-fatty acid), histamine antagonists, lovastatin (an inhibitor of HMG-CoA reductase, a cholesterol lowering drug, brand name MEVACOR® from Merck & Co., Inc., Whitehouse Station, N.J.), monoclonal antibodies (such as those specific for Platelet-Derived Growth Factor (PDGF) receptors), nitroprusside, phosphodiesterase inhibitors, prostaglandin inhibitors, suramin, serotonin blockers, steroids, thioprotease inhibitors, triazolopyrimidine (a PDGF antagonist), and nitric oxide. An example of an antiallergic agent is permirolast potassium. Other therapeutic substances or agents which may be appropriate include alpha-interferon, genetically engineered epithelial cells, rapamycin and dexamethasone.

Various combinations of solvents, polymers, mandrel materials, mandrel designs, stent materials, and stent designs as described above can be used so long as intended coating goals are met. Accordingly, while particular embodiments of the present invention have been shown and described, it will be obvious to those skilled in the art that changes and modifications can be made without departing from this invention in its broader aspects. Therefore, the appended claims are to encompass within their scope all such changes and modifications as fall within the true spirit and scope of this invention.

What is claimed is:

1. A method of applying a coating composition to a stent, comprising:

positioning a stent on a mandrel;

applying a coating composition including a solvent to the stent, wherein if the solvent is polar, then the mandrel selected for supporting the stent is made from or a surface of the mandrel is coated with a hydrophobic material; or if the solvent is non-polar, then the mandrel selected for supporting the stent is made from or the surface of the mandrel is coated with a hydrophilic material.

2. The method of claim 1, wherein the hydrophobic material has a δ value of about 9.9 $(cal/cm^3)^{1/2}$ or lower, and the hydrophilic material has a δ value of about 10.1 $(cal/cm^3)^{1/2}$ or higher.

3. The method of claim 1, wherein the polar solvent is selected from the group consisting of water, alcohol, dimethyl formamide, dimethyl sulfoxide, dimethyl acetamide, acetonitrile, methanol, acetone, isopropyl alcohol, tetrahydrofuran, isobutyl alcohol, n-propyl alcohol, and mixtures thereof.

4. The method of claim 3, wherein the hydrophobic material is selected from the group consisting of polymers of hydrocarbon, fluorocarbon, nylon, polyesters, silicone and silicone based materials.

5. The method of claim 1, wherein the hydrophobic material is selected from the group consisting of polymers of hydrocarbon, fluorocarbon, nylon, polyesters, silicone and silicone based materials.

6. The method of claim 1, wherein an outer surface of the mandrel is in at least partial contact with an inner surface of the stent.

7. The method of claim 1, wherein for a polar solvent, the mandrel or the coating of the mandrel is more hydrophobic than the stent or a coating on the stent, and wherein for a non-polar solvent, the mandrel or the coating of the mandrel is more hydrophilic than the stent or a coating on the surface of the stent.

8. The method of claim 1, wherein for a polar solvent, the mandrel or the coating of the mandrel is more hydrophobic than a material of an inner surface of the stent or a coating on the inner surface of the stent, and wherein for a non-polar solvent, the mandrel or the coating of the mandrel is more hydrophilic than the material of an inner surface of the stent or a coating on the inner surface of the stent.

9. The method of claim 1, wherein the mandrel includes members protruding from the mandrel for preventing an outer surface of the mandrel from making contact with an inner surface of the stent.

10. The method of claim 1, wherein the mandrel includes a first element to make contact with a first end of the stent, a second element to make contact with a second end of the stent, and a third element connecting the first element to the second element.

11. The method of claim 1, wherein the solvent is non-polar if it has a dipole moment of 0 debye.

12. The method of claim 1, wherein the solvent is non-polar if it has a dipole moment less than about 0.8 debye.

13. The method of claim 1, wherein the solvent is non-polar if it has a dipole moment less than about 1.4 debye.

14. The method of claim 1, wherein the surface of the mandrel is made from or coated with a wax.

15. The method of claim 14, wherein the wax is paraffin or ethylenic wax.

16. The method of claim 1, further comprising selecting the mandrel or the coating of the mandrel based on the coating composition properties.

17. The method of claim 1, wherein the solvent is polar and the hydrophobicity of the hydrophobic material making or coating the mandrel is at least 0.2 times greater than the stent or coating on the stent.

18. The method of claim 1, wherein the solvent is polar and the hydrophobicity of the hydrophobic material making or coating the mandrel is at least 0.5 times greater than the stent or coating on the stent.

19. The method of claim 1, wherein the solvent is non-polar and the hydrophilicity of the hydrophilic material making or coating the mandrel is at least 0.2 times greater than the stent or coating on the stent.

20. The method of claim 1, wherein the solvent is non-polar and the hydrophilicity of the hydrophilic material making or coating the mandrel is at least 0.5 times greater than the stent or coating on the stent.

21. The method of claim 1, wherein the solvent is polar and the polar solvent is selected from the group consisting of water, alcohol, dimethyl formamide, dimethyl sulfoxide, dimethyl acetamide, acetonitrile, methanol, acetone, isopropyl alcohol, tetrahydrofuran, isobutyl alcohol, n-propyl alcohol, and mixtures thereof; and wherein the hydrophobic material is selected from the group consisting of polymers of hydrocarbon, nylon, and polyesters.

22. The method of claim 1, wherein the solvent is non-polar and the non-polar solvent is selected from the group consisting of aliphatic hydrocarbons, cycloaliphatic hydrocarbons, aromatics, and mixtures hereof; and wherein the hydrophilic material is selected from the group consisting of metals, aluminum oxide, steel, and hydrophilic polymers.

23. The method of claim 1, wherein the solvent is polar, and the hydrophobic material is selected from the group consisting of polymers of hydrocarbon, nylon, polyesters, silicone and silicone based materials.

24. The method of claim 1, wherein the solvent is polar, and the polar solvent is selected from the group consisting of water, dimethyl formamide, dimethyl sulfoxide, dimethyl acetamide, acetonitrile, methanol, acetone, tetrahydrofuran, and mixtures thereof.

25. The method of claim 1, wherein the solvent is non-polar.

26. A method of coating a stent, comprising formulating a coating composition;

selecting a mandrel to support a stent during the application of the coating composition based on the ingredients of the coating composition and the material from which the stent is made or from which a coating on a surface of the stent is made;

positioning the stent on a mandrel;

applying the coating composition to the stent, wherein the contact angle of the composition on the surface of the stent or the coating on the surface of the stent is smaller than the contact angle of the composition on a surface of the mandrel, the contact angle being measured under ambient conditions.

27. The method of claim 26, wherein the contact angle of the composition on the surface of the mandrel is greater than 90°.

28. The method of claim 26, wherein an outer surface of the mandrel is in at least partial contact with an inner surface of the stent.

29. The method of claim 26, wherein the contact angle of the composition on the surface of the mandrel is greater than 80°.

30. The method of claim 26, wherein the contact angle of the composition on the surface of the mandrel is greater than 100°.

31. The method of claim 26, wherein the contact angle of the composition on the surface of the mandrel is greater than 110°.

32. The method of claim 26, wherein the contact angle of the composition on the surface of the mandrel is greater than 120°.

33. The method of claim 26, wherein the composition comprises a polymer dissolved in a solvent and optionally a therapeutic agent added thereto, and wherein the coating is applied in multiple layers by multiple applications of the coating composition where the solvent is removed after each application of the coating composition resulting in a layer of the multiple layers.

* * * * *